US007192391B2

(12) United States Patent
Kim

(10) Patent No.: US 7,192,391 B2
(45) **Date of Patent: *Mar. 20, 2007**

(54) VARIABLE SPRING RESISTANCE ASSEMBLY AND METHOD

(75) Inventor: Yong Woo Kim, Rochester, NY (US)

(73) Assignee: Kellion Corporation, Rochester, NY (US)

( * ) Notice: Subject to any disclaimer, the term of this patent is extended or adjusted under 35 U.S.C. 154(b) by 176 days.

This patent is subject to a terminal disclaimer.

(21) Appl. No.: 10/960,386

(22) Filed: Oct. 7, 2004

(65) Prior Publication Data

US 2005/0059535 A1 Mar. 17, 2005

Related U.S. Application Data

(63) Continuation-in-part of application No. 10/662,214, filed on Sep. 12, 2003, now Pat. No. 7,037,246.

(51) Int. Cl.
*A63B 21/04* (2006.01)

(52) U.S. Cl. ..... 482/129; 482/121; 482/99

(58) Field of Classification Search ..... 482/92, 482/93, 97–99, 121, 122, 130, 129, 133, 482/135

See application file for complete search history.

(56) References Cited

U.S. PATENT DOCUMENTS 1,738,987 A * 12/1929 Dattilo ..... 482/72
3,373,993 A 3/1968 Oja et al.
3,415,523 A 12/1968 Boldt
3,524,644 A 8/1970 Kane
3,640,529 A 2/1972 Kane
3,770,267 A 11/1973 McCarthy
4,600,196 A * 7/1986 Jones ..... 482/137
5,039,092 A * 8/1991 Olschansky et al. ..... 482/130
5,242,344 A 9/1993 Hundley
5,931,767 A * 8/1999 Morales ..... 482/102
6,042,523 A 3/2000 Graham
6,045,491 A 4/2000 McNergney et al.
6,142,919 A 11/2000 Jorgensen
6,431,991 B1 8/2002 Kossnar et al.
6,488,612 B2 12/2002 Sechrest et al.
6,551,196 B1 4/2003 Kossnar et al.
6,558,302 B2 5/2003 Cluff
6,561,956 B1 * 5/2003 Allison ..... 482/94
6,579,214 B2 6/2003 Crump
7,037,246 B2 * 5/2006 Kim ..... 482/129

* cited by examiner

*Primary Examiner*—Stephen R. Crow
*Assistant Examiner*—Allana Lewin
(74) *Attorney, Agent, or Firm*—Brown & Michaels, PC

(57) ABSTRACT

A variable spring resistance to movement of a rod uses a plurality of springs permanently connected between a base and a stack of end connector links extending in the direction of the rod movement. Selecting which of the links is connected to the rod then determines which of the springs are deployed to resist movement of the rod, without requiring any disconnection or reconnection of the springs. The selection can be made by a pin inserted through an aligned hole between a link and the rod. The arrangement can also be inverted with the springs connected between the links and a moving element, and the rod or other link selector being fixed to a base. Connecting one of the links to the rod then determines which of the springs will be extended between fixed and movable elements to establish a selectively variable spring resistance.

32 Claims, 4 Drawing Sheets

VARIABLE SPRING RESISTANCE ASSEMBLY AND METHOD

RELATED APPLICATIONS

This is a continuation-in-part patent application of application Ser. No. 10/662,214, filed 12 Sep. 2003 now U.S. Pat. No. 7,037,246, entitled "Spring Pack", hereby incorporated by reference.

BACKGROUND

Exercising devices often provide variable spring resistances for humans to work against while building and training muscles. Although different numbers of springs or other elastically deformable elements can be used to provide the variable resistance, springs and bungie cords, for example, have to be hooked up and unhooked to change the amount of resistance desired. Springs not in use have to be parked out of the way, and the hooking and unhooking of tension springs is time consuming and inconvenient. The connecting and disconnecting of springs can also result in springs snapping lose from a person's grip, and can cause minor injuries such as bruised or pinched fingers.

SUMMARY OF THE INVENTION

This invention solves the problem of connecting and disconnecting springs, bungie cords, and similar elastically extendable elements by providing a grouping of these elements, all in a connected condition, arranged so that a desired number of elements to be deployed for a resistance can be easily selected. The invention thus aims at packaging a collection of springs or resistance elements that need not be connected or unconnected during use, but also can be selected or specified in different numbers to provide a desired resistance. The selectable combination of spring resistances offered by the invention thereby improves speed and convenience and eliminates the annoyance of having to connect and disconnect springs to adjust an exercising resistance.

The preferred way of accomplishing these goals is to use an element whose movement is resisted by a selectable array of springs that remain connected to links or end connectors during the selection process, which involves attaching specific links or end connectors to a link selector. Without disconnecting or reconnecting any spring ends, different numbers of the plurality of springs can be deployed to resist a movement by varying the attachment of movable links or end connectors to the link selector or spring specifier. This can be done by arranging the end connectors in a stack and using an attachment device such as a pin and hole arrangement to select from the stack the end connector that will be attached to the spring specifier and thereby determine the number of springs that will be deployed to resist a movement.

DRAWINGS

DETAILED DESCRIPTION

Figure 1:
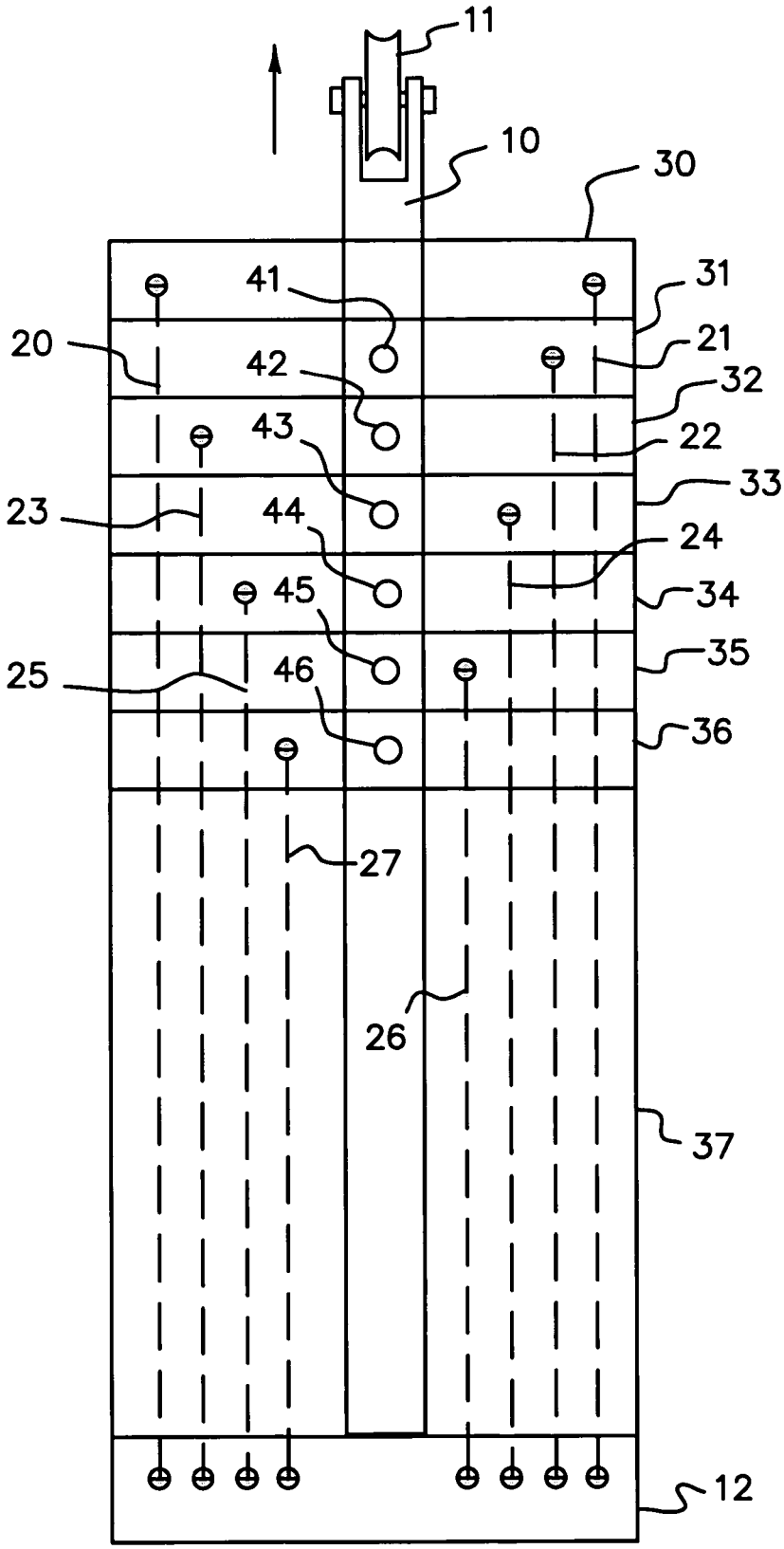
FIG. 1 is a partially schematic front elevational view of a preferred embodiment of spring pack according to the invention.
Figure 2:
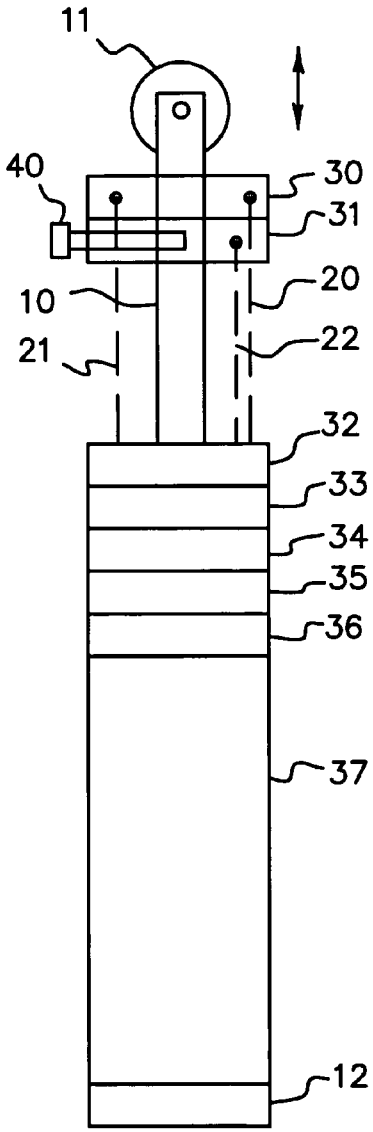
FIGS. 2 and 3 are partially schematic side elevational views of the spring pack of FIG. 1 showing selection of different numbers of springs to resist exercising movement.
Figure 3:
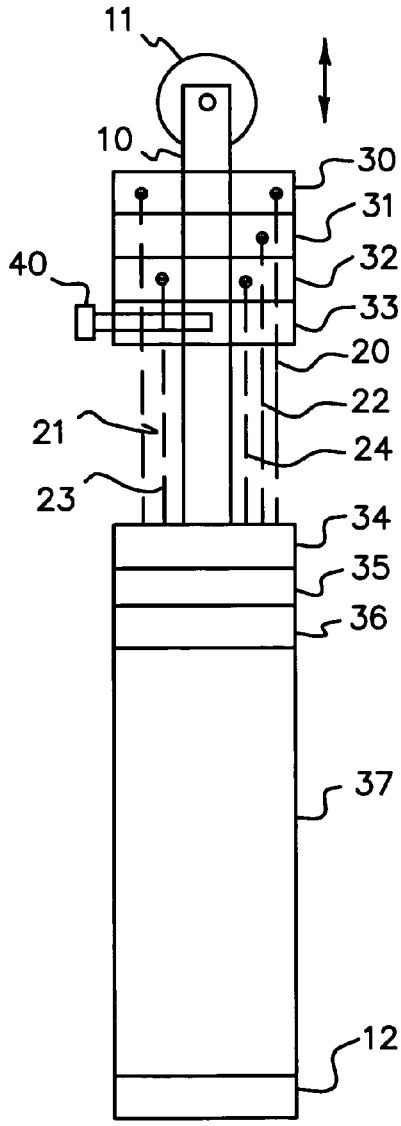
Figure 11:
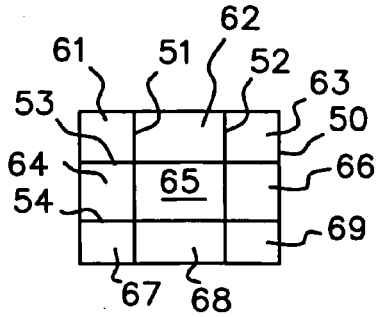
FIG. 11 is a partially schematic view of a preferred form of extrusion that is adaptable to form the links of FIGS. 4–10.
Figure 12:
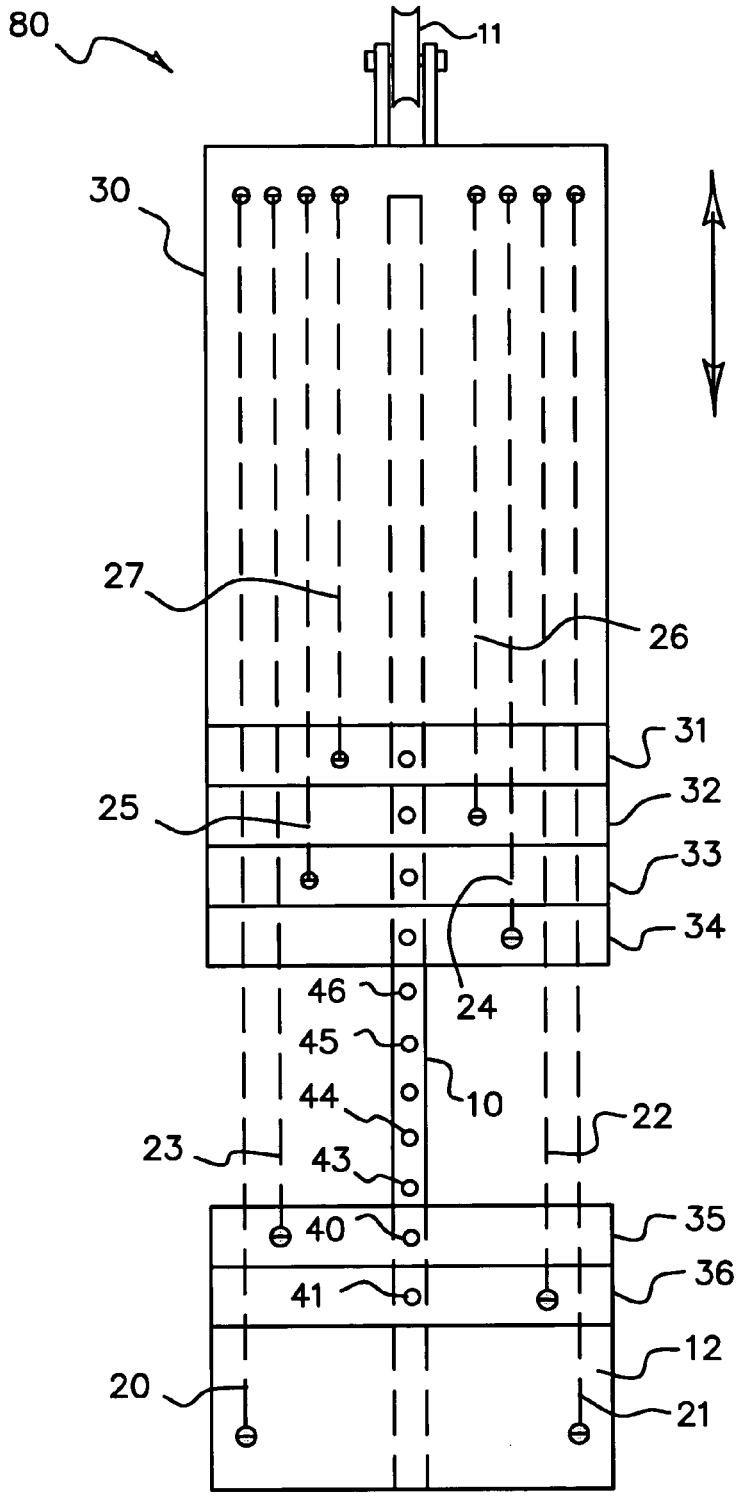
FIG. 12 is a partially schematic front elevational view, similar to the view of FIG. 1, and showing another preferred embodiment of the spring pack according to the invention.

One preferred embodiment of the invention is shown in FIGS. 1–3, and another preferred embodiment, inverting the arrangement, is shown in FIG. 12. Preferably both embodiments share the features illustrated in FIGS. 4–11, and each embodiment can be modified in obvious ways, once the operating principles are fully understood.

The illustrated embodiments of the invention were devised to facilitate selection of springs deployed to resist movement for exercising purposes. The inventive spring arrangement that is workable for variable exercising resistance can also be used for other purposes such as variable counter-balancing and variable spring energy storage. These other uses may need adaptations that differ in detail from the preferred embodiments described in this application.

Considering first the embodiment of FIGS. 1–3, the movement to be variably resisted includes a movable rod 10, which moves in a spring extending or spring resisted direction away from base 12 as shown by the arrow in FIG. 1. The extending or operational direction of movement of rod 10 is then resisted by different numbers of springs for exercising or other purposes. A pulley 11 mounted on rod 10 facilitates this by offering a connection to a cord or cable that may be part of a block and tackle system (not shown) to direct or proportion a movement resisted by rod 10.

A preferred material for forming rod 10 is a rectangular cross-sectioned tube or box beam, but many other forms are also possible. These include a cylindrical tube, a shaft, a tube or shaft having 5 or more sides, a channel or angle, an i-beam, t-beam, or h-beam or an assembly of such elements that can be made of metal or plastic, and possibly formed as an extrusion. The characteristics that are desirable for rod 10 are longitudinal uniformity and sufficient strength to endure the required spring resistance.

The springs 20–27, shown as broken lines in the drawings, are preferably coiled extension springs formed with hooks on each end, which are widely and inexpensively available. Other elastic elements capable of resisting movement in an extending direction can be substituted, though; these include bungie cords, elastic tubing, wound coil springs and pneumatic cylinders, all of which are hereafter included within the general terms "spring" or "springs". To simplify the drawings, the end connections of springs 20–27 are illustrated as dots in FIGS. 1–3.

All of the springs have fixed ends that are preferably connected to base 12, which remains motionless. Moving ends of the springs are then connected to links or end connectors 30–36. These are preferably arranged in a stack around rod 10 so that rod 10 can move up and down relative to base 12 and relative to any of the links that remain motionless. A preferably open channel 37 serves as a spacer and spring housing enclosure between base 12 and the nearest spring end connector link 36.

Springs 20–27 are preferably somewhat extended and therefore under light tension when connected to links 30–36 in the home position shown in FIG. 1. Springs 20–27 then hold links 30–36 under slight compression in the illustrated stacked arrangement. For this purpose, links 30–36 preferably engage each other around their respective peripheries to remain snugly stacked during operation. To accommodate this arrangement, springs 20–27 can have different lengths and different spring resistances.

For exercise purposes it is undesirable for rod 10 to be free to move without any spring resistance, and to achieve this link 30, which is farthest from base 12, is preferably permanently connected to rod 10 so that link 30 always moves with rod 10. Link or end connector 30 can also serve as the mount for pulley 11, and end connector 30 can be considered as an element whose movement is to be resisted by different numbers of springs. In the illustrated embodiment, springs 20 and 21 are connected to link 30 so that these two springs always resist movement of rod 10 and element 30. It is also possible to devote only a single spring to permanent resistance of movement of rod 10, or to make link 30 selectively connectable to rod 10 so that rod 10 is free to move without any spring resistance.

Rod 10 preferably has a series of holes 41–46 that align with corresponding holes 41–46 in links 31–36. Since holes 41–46 in both links and rod are aligned in the home position illustrated in FIG. 1, a single circle represents each of the aligned holes.

To select which of the springs 22–27 will additionally resist movement of rod 10, it is merely necessary to connect one of the links 31–36 with rod 10. This can be conveniently done with a pin 40 insertable through one pair of the aligned holes 41–46 to pin the selected link to rod 10.

The selecting and pinning of different links to rod 10 is best shown in FIGS. 2 and 3. In FIG. 2, link 31 is connected to rod 10 by pin 40 so that links 30 and 31 move with rod 10. This adds spring 22 to the basic movement resistance otherwise applied by springs 20 and 21. When pin 40 connects link 33 to rod 10, as shown in FIG. 3, links 30–33 move with rod 10 while supplying resistance by springs 20–24. FIGS. 2 and 3 thus illustrate that any link on an exercising or resisted direction side of a link pinned to rod 10 will move with rod 10, and any link left on a base side of a pinned link remains with base 12 and channel 37 while rod 10 moves. Moving pin 40 into different aligned holes 41–46 when the spring pack is in the home position shown in FIG. 1, thereby determines which of the links is pinned to rod 10 and also establishes which of the links will deploy spring resistances to rod movement, and which of the links, if any, will remain on the base side of the pinned link and will not deploy spring resistance to rod movement. The illustrated arrangement can thus resist rod movement by different numbers of springs ranging from 2 to 8, simply by selecting which of the aligned holes 41–46 will be used for connecting insertion of pin 40. This variable spring resistance is also accomplished without any need to disconnect or reconnect any of the spring ends.

Figure 9:
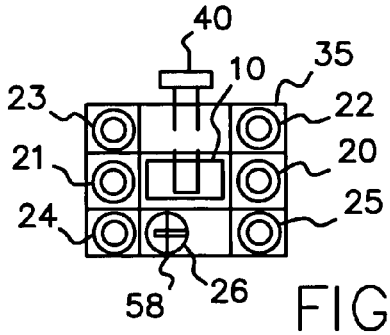
Figure 10:
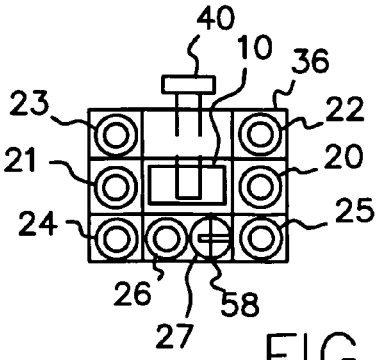

Each of the links 30–36 can conveniently be formed as an extrusion shaped as a box beam 50 as shown in FIG. 11, with intersecting interior cross-webs 51–52, in a tic-tac-toe pattern, dividing the interior of beam 50 into nine compartments 61–69. Such an arrangement can create passageways through the compartments for a spring to extend through one link to a connection with another link spaced farther from base 12. Also, using the same basic extrusion pattern shown in FIG. 11, it is possible to form three adaptations of the basic extrusion 50 supplying spring connecting webs across different ones of the compartments, as shown in FIGS. 4–10.

Figure 4:
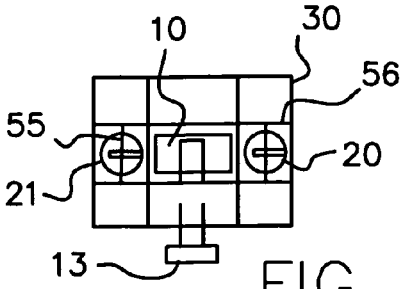
FIGS. 4–10 are partially schematic views of different links or end connectors in a stack arranged to require a different number of springs to move with a rod.

The preferred permanent connection of link 30 to rod 10 can be done with some sort of fastener that is schematically illustrated as a screw or pin 13 in FIG. 4. Many other fasteners, adhesives, or weldments are possible to accomplish this connection. A pair of spring connecting webs 55 and 56 is formed to extend across a pair of compartments, such as compartments 64 and 66. Compartmental cross-webs 55 and 56 afford connections for hooks on the ends of springs 20 and 21, which are thereby deployed to resist any movement of rod 10 in an operative or extending direction.

Figure 5:
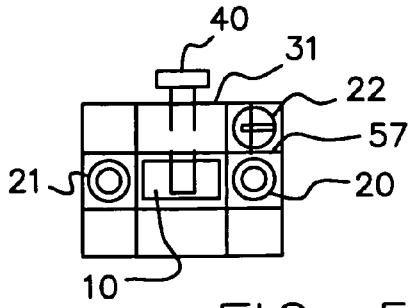
Figure 6:
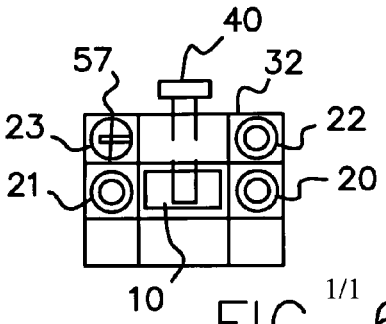
Figure 7:
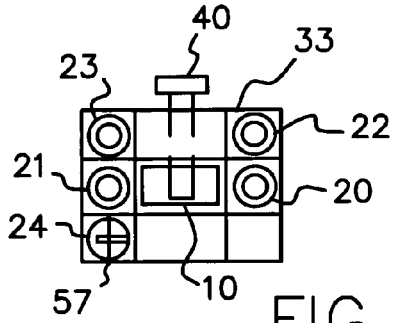
Figure 8:
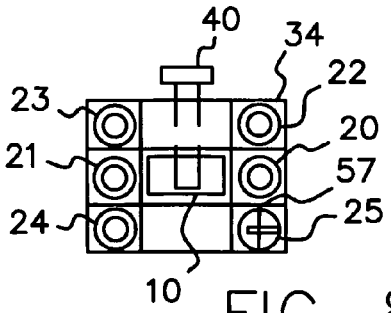

Another extrusion, used for links 31–38, provides a spring connecting link in a corner compartment, such as compartment 63 as illustrated in FIG. 11. Since each link 31–34 is formed of a short cutoff length of an extrusion having spring connector 57 in a corner position, such links can be flipped over right-to-left or top-to-bottom so as to dispose spring connecting web 57 in any corner of the link stack. Thus, link 31 disposes spring connector 57 in an upper right hand corner as shown in FIG. 5. This allows springs 20 and 21 to pass through link 31 while spring 22 attaches to connector 57 in the compartment 63 position. Another link 32 in a right-to-left flip over position shown in FIG. 6 disposes spring connector 57 in the upper left or 61 position compartment where it affords a connection to spring 23 while allowing springs 20–22 to pass through. The same extrusion reoriented in a top-to-bottom flip, as shown for link 33 in FIG. 7, disposes spring connector 57 in a lower left corner in the compartment 67 position. Here, spring 24 attaches to connector 57, while link 33 affords through passageways for springs 20–23. Finally, link 34, in another flipped over position, disposes spring connector 57 in a lower right corner compartment position 69 to connect to spring 25 while leaving through passageways for springs 20–24. Successive springs in the link stack are preferably arranged on opposite sides of rod 10 to keep spring forces approximately balanced.

The arrangement of FIGS. 4–8 provides variable spring resistance arranging from two to six springs, and achieves this with two spring connector variations of a basic extrusion patterns. FIGS. 9 and 10 show how two more springs can be added by using another spring connector position 58 connecting to springs 26 and 27. If sufficient room is provided in compartments 62 and 68, spring connector 58 can be oriented in different positions to add two more springs to each of these compartments. Such added springs should avoid interference with placement of connecting pin 40, and as such added springs are desired, it would be preferable to divide each of the compartments 62 and 68 into separate spring compartments to eliminate any interference or noise between adjacent springs.

Compartmented extrusions can also be arranged in many other configurations that can house a desired number of springs to be selectively deployed to resist the movement. One possibility is a radially variable or rotatable link that can dispose spring passages and spring connectors in different positions around a preferably multisided rod. The decisions can be based on the number of springs desired, the space available, and the attractiveness and economy of the end result. Another consideration is to leave one of the compartments free of springs so as to accommodate placement of pin 40. The number of links and springs can be increased to meet any conceivable need.

Springs can have end connections made without using hooks formed at the ends of springs, and connectors are known that interlock between spring coils near a spring end. Hooks formed on end coils of springs are inexpensive and commonplace, though, and can readily be connected to links 30–36, simply by hooking over spring connector webs 56–58 as a spring pack is assembled. Once this is done, the springs need not be disconnected or reconnected again, because their selection can be achieved simply through placement of pin 40.

Instead of a single pin 40 disposable in a selected one of the aligned holes 41–46, a connecting pin can be pivotally mounted on each link and can be pushed into an operative position or pulled to an inoperative position. A sliding bar, hook, or other element can be substituted for pin 40, and a pin can be inserted into rod 10 in a space made available between links.

The arrangement explained above for the embodiment 80 of FIGS. 1–3 can be inverted, as schematically illustrated in FIG. 12. The inversion embodiment of FIG. 12 also illustrates different functions that elements of the invention can serve. For example, a rod 10 need not be a movable element, because it can remain fixed with a base 12, as illustrated. Rod 10, with its series of holes 41–46, remains a link selector or spring specifier and provides a way of determining which link will remain fixed and which link will be allowed to move with pulley 11. In the FIG. 12 embodiment, the pinned links 36 and 35 remain fixed with rod 10 to base 12 where they cause springs 20–23 to be extended in movement resistance. The unpinned links 31–34 remain connected to movable element 30 by springs 24–27 which do not offer resistance to movement. In a home position of embodiment 80, pin 40 can be moved to pin any one of the links 31–36 to rod 10 so that from two to eight springs can resist movement of element 30 and pulley 11.

One preference for embodiment 80 is that pin 40 remains fixed while element 30 moves as shown by the double-headed arrow. This allows the entire assembly 80 to be mounted in a housing or channel where it is concealed from view. Pin 40 can then be inserted through a hole in such a housing or channel into a corresponding hole in links 31–36 to specify a link without the need for any rod 10.

Comparing the FIG. 12 embodiment 80 with the relatively inverted embodiment of FIGS. 1–3 shows that a link selector or spring specifier can be arranged to move or to remain fixed and still perform the necessary spring resistance selection. Variably selectable springs can have one end connected to links or end connectors for such a selection process, but the other ends of the springs can be connected either to a movable element, as in FIG. 12, or a fixed base, as in FIG. 1.

A rod or other link joiner device can be arranged to extend through a stack of links, as illustrated, or to surround or straddle a stack of links in a variety of ways. The requirements include some way of connecting any one of the links to the link selector or joiner device so as to determine which springs will afford resistance to movement, but otherwise the link selector mechanism can be either fixed or movable.

The link selector or spring specifier preferably serves a guiding function for the links that remain free to move after a link is pinned to the selector. A housing or tube containing a link stack can serve this function, and holes formed in the wall of a housing or tube can be used for pinning one of the links in place. When an end connector in the middle of a stack is pinned to a spring specifier, this permits some of the end connectors to move and other end connectors to remain fixed. The distinction between the movable and fixed end connectors thereby determines which of the springs will be deployed to resist the movement and which will remain unextended while a movement occurs.

What is claimed is:

1. A method of selecting different numbers of extension springs to resist movement of an element that moves against spring resistance, the method comprising:

operatively connecting one end of each of the springs to a common connector;

operatively connecting another end of each of the springs to a respective one of a plurality of links arranged in a stack extending in a direction of the movement of the element;

arranging a link connector to extend in the direction of the link stack so that any selected one of the links in the stack can be connected to the link connector:

moving the element to cause relative movement between the link connector and the common connection; and arranging the connection of a selected one of the links to the link connector, without any change in the spring end connections, to determine which of the links of the link stack that are not connected to the link connector will deploy their respective springs to resist the relative movement and which of the links of the link stack that are not connected to the link connector will not deploy their respective springs to resist the relative movement.

2. The method of claim 1 including inserting a pin through a hole in a link and into a registered hole in the link connector as the means for selectively attaching one of the links to the element.

3. The method of claim 2 including using a home position of the link connector and the link stack when selectively attaching one of the links to the link connector.

4. The method of claim 1 including forming the links with through passageways allowing a spring attached to one link to pass through another link.

5. The method of claim 1 including arranging springs to pass through links nearer to the base common connection to reach links farther from the base common connection.

6. The method of claim 1 including arranging the link connector to extend through the link stack.

7. A spring deployment selector using an element movable in an exercising direction and a plurality of springs extendable in the exercising direction to resist movement of the element, the selector comprising:

the springs remaining operationally connected between a common connection and a plurality of movable links arranged in a stack extending in a spring extending direction;

some of the springs extending past some of the links in the stack to connect to other links in the stack;

the links, while remaining connected to the springs, being selectively attachable to a link connector so that relative movement can occur between the common connection and the link connector;

attachment of a selected one of the links to the link connector determining which of the unattached links in the stack will move and which of the unattached links in the stack will not move when the relative movement between the common connection and the link connector occurs; and using the determination of which links move and which links do not move in response to the relative movement to determine which springs will be extended to resist the relative movement and which springs will not be extended in response to the relative movement.

8. The selector of claim 7 wherein movement of the link connector is guided through the stack.

9. The selector of claim 7 wherein the links have holes, the red link connector has a series of holes alignable with the link holes, and a pin is insertable through a hole in a selected link and through a registered hole in the link connector to attach the a selected link to the link connector.

10. The selector of claim 7 wherein the links are configured to allow springs to pass through links.

11. The selector of claim 7 wherein the links have a spring connection that can be oriented in different positions as the links are arranged in the stack.

12. A spring deployment selector comprising:

a plurality of springs and a corresponding plurality of spring links to which the springs are respectively connected;

the springs also being connected to a common connection to extend from the common connection to the respective spring links;

the spring links being arranged in a stack to allow springs to extend through links;

a link selector extending along the stack of spring links so that relative motion can occur between the link selector and the common connection;

the links having holes and the link selector having a corresponding plurality of selector holes registerable with the link holes;

a pin insertable through a link hole and bite through a link selector hole being effective to selectively attach one of the links to the link selector; and the links and springs being ananged so that the selective attachment of a single one of the links to the link selector, without changing any spring connections, determines which portion of the link stack stays with the link selector and which portion of the link stack stays with the common connection and thereby determines which of the springs resist the relative movement between the common connection and the link connector of an element movable in a spring extending direction.

13. The selector of claim 12 wherein the link selector extends through the link stack.

14. The selector of claim 12 wherein the links are formed as extrusions that can be arranged in different orientations around the link selector.

15. The selector of claim 12 wherein the links are configured to allow springs to connect to links in different orientations.

16. The selector of claim 12 wherein bias of the springs holds the link stack together until separated by attachment of the selected link and occurrence of the relative movement.

17. The selector of claim 16 wherein the link stack, the link selector, and the common connection are in a home position when the pin is inserted through a link hole and a link selector hole.

18. A variable spring resistance assembly using a plurality of springs and comprising:

each of the springs having first ends that remain connected to a common connector and having second ends that remain connected respectively to a corresponding plurality of links ananged in a stack so that springs can pass through links to reach other links;

a link connector extending along the stack of links;

the link connector and the common connector being ananged to move relative to each other in a direction aligned with the link stack: and the movable links being selectively and singly connectable to the link connector without changing spring end connections so that the selected link connected to the link connector determines the which unconnected links of the link stack move relative to the common connector when the relative movement occurs and thereby determines which springs will resist the relative movement.

19. The resistance assembly of claim 18 wherein the springs are extended between the common connector and the link connector and thereby bias the link stack toward a home position.

20. The resistance assembly of claim 18 wherein holes in the links register with holes in the link connector, so that a pin is insertable through a link hole and a link connector hole to attach the selected link to the link connector.

21. A spring resistance assembly deploying different numbers of a plurality of springs to resist a movement, the spring assembly comprising:

the springs being connected between a common connector and a corresponding plurality of end connectors;

a spring specifier arranged adjacent to the end connectors;

the end connectors being selectively and singly attachable to the spring specifier; and the end connectors and springs being ananged so that the attachment of a selected one of the end connectors to the spring specifier divides the end connectors between a portion of the unselected end connectors that stay with the spring specifier and a portion of the unselected end connectors that stay with the common connector when relative movement occurs between the spring specifier and the common connector, which thereby determines which springs resist the relative movement.

22. The spring resistance assembly of claim 21 wherein the end connectors are arranged in a stack so that the division of the end connectors between portions occurs within the stack.

23. The spring resistance assembly of claim 21 wherein the end connectors are configured to allow springs to pass through one end connector to reach another end connector.

24. The spring resistance assembly of claim 21 wherein at least one spring is connected to resist the relative movement regardless of the end connector attached to the spring specifier.

25. The spring resistance assembly of claim 21 wherein the spring specifier is a rod that moves when the relative movement occurs, so that the selected end connector pinned to the rod determines which of the springs move with the rod and thereby extend to resist the relative movement.

26. The spring resistance assembly of claim 21 wherein the spring specifier is a rod that is fixed to a base, and the springs are connected between the end connectors and an element that moves, so that the end connector attached to the rod determines which of the end connectors remain fixed and which springs thereby resist the movement of the movable element.

27. A spring deployment combination comprising:

a plurality of springs;

a plurality of links connected to the springs;

a common connector to which the plurality of springs are connected;

a movable element;

a link joiner;

an attacher allowing any one of the links to be attached to the link joiner; and the link joiner being disposed relative to the base and to the movable element so that attaching one of the links to the link joiner establishes that unattached links on one side of the attached link stay with the common connector when the element moves and unattached links on another side of the attached link stay with the link joiner when the element moves, which thereby determines which springs resist movement of the element.

28. The spring deployment combination of claim 27 wherein the link joiner is a rod extending through a stack of the links.

29. The spring deployment combination of claim 27 wherein the link joiner moves with the movable element, and the springs connect between a fixed base and the links.

30. The spring deployment combination of claim 27 wherein the link joiner is fixed to the base, and the springs connect between the links and the movable element.

31. A spring deployment selector comprising:

a) a plurality of springs connected between a movable element and a plurality of links arranged in a stack;

b) a spring specifier fixed in place and arranged so that a selected one of the links can be connected to the spring specifier; and c) connection of the selected one of the links to the spring specifier being arranged to determine a number of the links and springs that are allowed to move with the movable element without resistance and the number of the links and springs held fixed to resist movement of the movable element.

32. The spring deployment selector of claim 31 wherein the spring specifier is a rod that extends along the stack of links, and the links have passageways allowing springs to pass through links.

* * * * *